United States Patent [19]

Yasuda et al.

[11] Patent Number: 4,628,295

[45] Date of Patent: Dec. 9, 1986

[54] TEMPERATURE RESPONSIVE SWITCH

[75] Inventors: Keiji Yasuda, Handa; Hideo Haneda, Toyota, both of Japan

[73] Assignee: Aisin Seiki Kabushiki Kaisha, Aichi, Japan

[21] Appl. No.: 730,148

[22] Filed: May 3, 1985

[30] Foreign Application Priority Data

May 4, 1984 [JP] Japan ..... 59-065596[U]

[51] Int. Cl.[4] ..... H01H 37/52

[52] U.S. Cl. ..... 337/354; 337/62

[58] Field of Search ..... 337/354, 62

[56] References Cited

U.S. PATENT DOCUMENTS 3,205,328 9/1965 Maytnier ..... 337/354

*Primary Examiner*—Harold Broome

*Attorney, Agent, or Firm*—Sughrue, Mion, Zinn Macpeak & Seas

[57] ABSTRACT

A temperature responsive switch having a bimetal disc disposed within a recess in the switch body is provided with a guide member having a hole extending therethrough and a sperical shaped transmitting member disposed in the hole in contact with the bimetal disc. A leaf spring is secured to the body at one end thereof in overlying relation to the hole in engagement with the spherical shaped transmitting member. A moveable contact is fixed to the other end of the leaf spring and a stationary contact is provided on the body adjacent the moveable contact. A spring normally disposed between the body and the leaf spring biases the leaf spring in a direction to separate the contacts and upon over center movement of the bimetal disc the spherical shaped transmitting member will move the leaf spring against the force of the spring to bring the contacts into engagement with each other.

1 Claim, 1 Drawing Figure

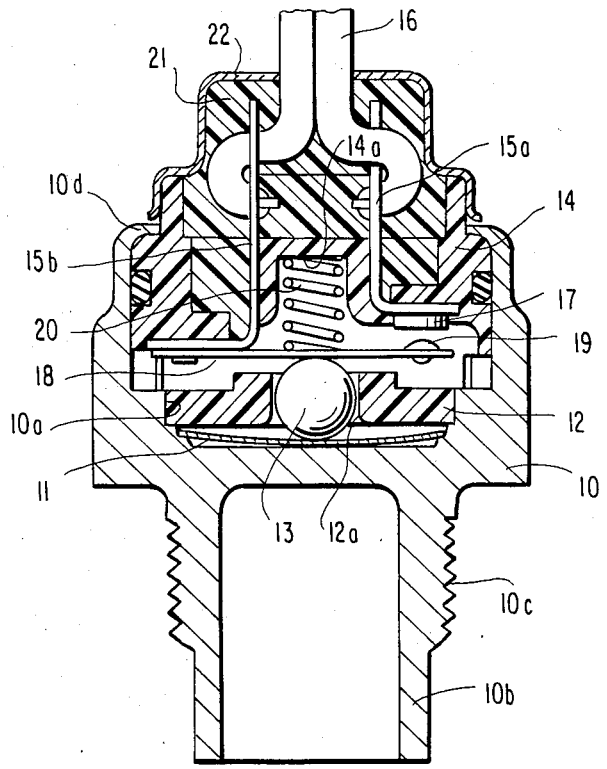
16
22
21
14a
15a
10d
14
15b
17
20
19
18
10a
12
11
10
13
12a
10c
10b

TEMPERATURE RESPONSIVE SWITCH

BACKGROUND OF THE INVENTION

The present invention is directed to a temperature responsive switch having a contact adpated to be moved by the snap action of a temperature responsive bimetal disc and more specifically to a temperature responsive switch having a force transmitting means disposed intermediate the contact and the bimetal disc.

A conventional temperature switch is disclosed in Japanese Pat. No. 50-38197. This conventional temperature switch is provided with a cylindrical rod which transmits the snap action of the bimetal disc to a moveable contact so that the moveable contact is moved into contact with a stationary contact. The cylindrical rod is slidably guided within a hole extending through a body member. The moveable contact is arranged at the edge of a leaf spring and the cylindrical rod is engageable with the leaf spring adjacent the mid-portion thereof so as to widen the gap between the moveable contact and the stationary contact. However, it is difficult in this conventional temperature switch to maintain a constant gap between the contacts since errors in the length of the cylindrical rod affect the gap directly through the leaf spring. Furthermore, when a substantial clearance is provided between the cylindrical rod and the hole the gap between the contacts will vary in a manner responsive to the inclination of the cylindrical rod in the hole. However, if the clearance between the cylindrical rod and the hole is substantially reduced the cylindrical rod tends to move unevenly due to a sticking action of the rod within the hole. Thus the operation of the temperature responsive switch is unreliable.

SUMMARY OF THE INVENTION

The present invention provides a new and improved temperature responsive switch which overcomes the aforementioned disadvantages of prior art switches.

The present invention provides a new and improved temperature responsive switch having a novel force transmitting means which can reduce the influence of the length of the forced transmitting means as well as reduce the influence of the clearance between the transmitting means and the hole relative to the consistent operation of the switch.

The present invention provides a new and improved temperature responsive switch which is extremely efficient, reliable and low in cost.

The present invention provides a new and improved temperature responsive switch comprising a switch body, a bimetallic disc disposed within said body, a guide member having a hole therethrough secured to said body, a leaf spring secured to said body at one end thereof and extending over said hole, a spherical shaped transmitting means disposed in said hole in engagement with said bimetallic disc and said leaf spring, a moveable contact fixed to the other end of said leaf spring and a stationary contact fixed to said body adjacent said moveable contact, spring means disposed between said body and said leaf spring for biasing said leaf spring in a direction to separate said contacts and wire means connected to said contacts. Since the forced transmitting means has a spherical configuration no inclination can occur between the transmitting means and the hole so that the gap between the bimetal disc and the leaf spring is maintained constant. Furthermore the spherical shaped transmitting means has minimal contact with the hole and tends to move with a rolling action thereby eliminating any possibility of sticking.

The foregoing and other objects, features and advantages of the invention will be apparent from the following more particular description of a preferred embodiment of the invention as illustrated in the accompanying drawings.

BRIEF DESCRIPTION OF THE DRAWING

The sole FIGURE is a longitudinal sectional view of a temperature responsive valve according to the present invention.

DETAILED DESCRIPTION OF THE INVENTION

The temperature responsive switch shown in the drawing is comprised of a body 10 made of heat conducting material, as for example aluminum. The body 10 is provided with a recess 10*a* which opens upwardly as viewed in the drawing and a cylindrical projecting wall 10*b* extending in the opposite direction and having a screw thread 10*c* formed on the external surface thereof for mounting the switch body in a suitable support, the temperature of which is to be sensed. A bimetal disc 11 is disposed in the bottom of the recess 10*a* and a guide member 12 is fixed within the recess 10*a* above the bimetal disc 11. The guide member 12 is provided with a centrally located hole 12*a* and a spherical transmitting member 13 is disposed within the hole 12*a*. A block member 14 made of insulating material, as for example plastics material, is located in the outer end of the recess 10*a* in spaced relation to the guide member 12 and is secured within the recess by the inwardly bent end portions 10*d* of the body wall defining the recess 10*a*.

Terminals 15*a* and 15*b* are secured to the block member 14 and extend into the space between the block member 14 and the guide member 12. The terminals are connected to wires 16 which extend outwardly through a cap member 22 secured to the top of the block member 14. A synthetic resin material 21 is molded within the cap member 22 to encapsulate the connection between the wires 16 and the terminals 15*a* and 15*b*.

The terminal 15*a* is provided with a stationary contact 17. One end of an electrically conductive leaf spring 18 is secured to the terminal 15*b* and a contact 19 is secured to the other end of the leaf spring for movement into and out of engagement with the fixed contact 17. The block member 14 is provided with a recess 14*a* and a coil spring 20 is disposed within the recess 14*a* and in engagement with the leaf spring 18 for normally biasing the leaf spring 18 into contact with the spherical transmitting means 13 with the contacts 17 and 19 spaced from each other.

In operation a temperature responsive switch according to the present invention may be used to detect engine coolant temperatures. The body 10 may be screwed into an aperture in the wall of an engine block by means of the screw threads 10*c* so that the temperature of the engine coolant circulating within the engine block may be sensed by the bimetal disc 11. When the coolant temperature is below a predetermined level the bimetal disc 11 snaps over center to a downwardly convex configuration as shown in the drawing. Thus the leaf spring will be biased downwardly by means of the spring 20 so that the moveable contact 17 is spaced from the stationary contact 19.

When the temperature increases above a predetermined level the bimetal disc 11 will snap over center to an upwardly convex configuration so as to bias the spherical transmitting means 13 upwardly against the biasing force of the spring 20. Thus the leaf spring 18 is moved upwardly so that the moveable contact 19 contacts the stationary contact 17.

When the temperature decreases below the predetermined level again the bimetal disc 11 will snap over center to the downwardly convex position so that the moveable contact 19 will again be spaced from the stationary contact 17.

While the invention has been particularly shown and described with respect to a preferred embodiment thereof it will be understood by those in the art that various changes in form and details may be made therein without departing from the spirit and scope of the invention.

What is claimed is:

1. A temperature responsive switch comprising a switch body, a bimetallic disc disposed in said switch body and adapted to be snapped over center in response to changes in the surrounding temperature, a guide member disposed within said body adjacent said bimetal disc and having a hole extending therethrough, a spherical member moveably disposed within said hole of said guide member in contact with the center of said bimetal disc, an electrically conductive leaf spring fixed to said body at one end thereof and overlying said hole in engagement with said spherical member, an electrical contact secured to the other end of said leaf spring for movement therewith in response to movement of said spherical member, a stationary electrical contact fixed within said switch body for contact by said moveable electric contact upon movement thereof in response to changes in the configuration of said bimetal disc in response to temperature changes and biasing means disposed within said body for normally biasing said leaf spring in a direction towards the spherical member to separate said electrical contacts.

* * * * *